United States Patent [19]

Player et al.

[11] Patent Number: 4,646,980

[45] Date of Patent: Mar. 3, 1987

[54] CONE DISCHARGE FOR DIAPHRAGM DISCHARGE ROTARY GRINDING MILL

[75] Inventors: Duane W. Player, Salt Lake City, Utah; Peter W. Leach, Fort Collins, Colo.

[73] Assignee: Evans Products Company, Wilmington, Del.

[21] Appl. No.: 736,426

[22] Filed: May 20, 1985

[51] Int. Cl.[4] ..... B02C 17/18

[52] U.S. Cl. ..... 241/179

[58] Field of Search ..... 241/170–184, 241/299, 285 R

[56] References Cited

U.S. PATENT DOCUMENTS

| | | |
|---|---|---|
| 1,361,280 | 12/1920 | Newhouse . |
| 1,601,466 | 9/1926 | Benna . |
| 1,642,122 | 9/1927 | McMahon . |
| 2,023,331 | 12/1935 | Lowenhielm . |
| 2,259,769 | 10/1941 | Newhouse . |
| 2,405,633 | 8/1946 | Barker et al. . |
| 3,206,128 | 9/1965 | MacPherson et al. . |
| 3,599,882 | 8/1971 | Sabaski et al. . |
| 3,604,637 | 9/1971 | Sabaski . |
| 3,739,993 | 6/1973 | Nelson et al. . |
| 3,806,045 | 4/1974 | Jenness . |
| 4,172,560 | 10/1979 | Butler . |
| 4,185,785 | 1/1980 | Nelson . |
| 4,266,733 | 5/1981 | Butler . |
| 4,334,626 | 6/1982 | Butler . |

*Primary Examiner*—Mark Rosenbaum

*Attorney, Agent, or Firm*—Merchant, Gould, Smith, Edell, Welter & Schmidt

[57] ABSTRACT

A discharge cone casting for the discharge end of a rotary mill is disclosed which is integrally cast in a single component. The casting specifically consists of a generally flat base member adapted to conform to the discharge end of the mill and having converging sides, a top member having converging sides similar to those of the base member and disposed in overlying relation but also including a portion that extends beyond the base member and curving toward its plane, and an interconnecting web extending transversely between the base and top member to define a generally I-shaped cross section. Mounting bolt holes are formed through the upstanding web to enable the discharge cone casting to be bolted directly to the mill end as a single unit.

13 Claims, 14 Drawing Figures

CONE DISCHARGE FOR DIAPHRAGM DISCHARGE ROTARY GRINDING MILL

The invention broadly relates to discharge end assemblies for rotary grinding mills, and is specifically directed to an improved discharge cone casting for such assemblies.

Rotary grinding mills are used to reduce or comminute ore fragments by tumbling the fragments to impact upon themselves, or to be impacted by balls or rods.

The rotary grinding mill conventionally consists of a large cylindrical drum having an axial inlet centrally disposed in one end of the drum and a centrally disposed outlet at the other. The ore charge is introduced into the inlet, from which it is disseminated radially outward through an assembly of feeder castings to the inner cylindrical surface of the drum. The drum surface is provided with a liner assembly having axially extending lifter bars to lift the ore fragments and cause them to tumble and become comminuted.

As the ore fragments are reduced in size, they progress toward the discharge end of the mill, which is provided with an assembly of discharge castings the function of which is to channel the comminuted ore radially inward and then axially outward to the mill outlet.

Conventionally, the discharge end assembly comprises a plurality of tiers of castings, each tier itself comprising a plurality of castings and being disposed in an annular configuration. The respective tiers have progressively smaller diameters and are concentrically disposed, occupying the mill discharge end from the cylindrical shell surface approximately to a point where the mill end curves to the axial discharge outlet.

The radially outermost tier is provided with grates adjacent the cylindrical surface of the drum to receive the comminuted ore, and the grates communicate with a plurality of radial channels defined within the tiers of castings that guide the comminuted ore toward the mill outlet.

The discharge end assembly further comprises a plurality of discharge cone castings, disposed centrally of the drum between the innermost tier and the mill outlet, the function of which is to receive the comminuted ore from the radial channels within tiers of castings and cause it to flow smoothly in the transition from radially inward flow to axially flow.

Because the discharge cone castings channel the flow of comminuted material through substantially a 90° turn, and coupled with the fact that the flow of material converges radially toward the axial outlet, the discharge cone castings are subjected to significant abrasion and wear. The problem is compounded by prior art discharge cone castings which, due to their complex configuration, have been made up of a plurality of components that are bolted together at the time of installation. The multi-component discharge cone castings necessarily have internal joints, and the comminuted material wears the castings in the joint area much more rapidly.

In addition, the multi-component aspect of the discharge cone casting makes it more difficult to install and remove, and due to the extreme weight of the individual castings, this also represents a potential hazard to personnel involved in casting removal and replacement.

Another problem encountered with prior art discharge cone castings is shifting of the casting assembly during operation. This is the result of using mechanical wedging in prior art structures, both in radial and lateral directions, to hold the assembly in place. With such mechanical wedging, it is possible for the wedges to become loosened during operation, which results in shifting or movement of the assembly and in reduction in effectiveness.

Last, because of the multi-component approach, wear of the castings is often uneven, necessitating the premature replacement of one component while the remaining components do not require replacement. This problem is compounded by the fact that the component immediately adjacent the mill end generally wears most rapidly, requiring removal of all components of the cone discharge casting for replacement purposes. This results in increased maintenance and downtime, thus decreasing the effectiveness of the mill and increasing its cost of operation.

SUMMARY OF THE INVENTION

The subject invention is directed to an improved discharge cone casting which is uniquely configured to be integrally cast in a single component. The single casting has no joints, and inherently resists abrasive wear by the comminuted material and lasts longer. Further, the integral casting is advantageously designed with rounded areas where joints previously existed to further reduce wear, and it is thickened in high-wear areas and thinned in low-wear areas so that overall wear is balanced and uniform. As a result, premature wear in critical areas is avoided, and replacement of all cone discharge castings is predictable and accomplished at the same time.

The integral casting is also designed with a single, centrally located upstanding web in which a plurality of mounting bolt holes are formed. This enables the cone discharge castings to be bolted directly to the mill end firmly and securely, obviating the wedge-type approach of prior art structures and the problem of shifting.

Further, the integral cone discharge casting is far easier to remove and install, obviating the problem of multiple components, which require individual handling, difficulty in assembly and alignment, and related hazards.

Based on the foregoing features and advantages, the inventive integral discharge cone casting lasts longer, requires less maintenance, decreases replacement time and thus leads to less mill downtime and reduced mill maintenance costs.

DESCRIPTION OF THE PREFERRED EMBODIMENT

Figure 1:
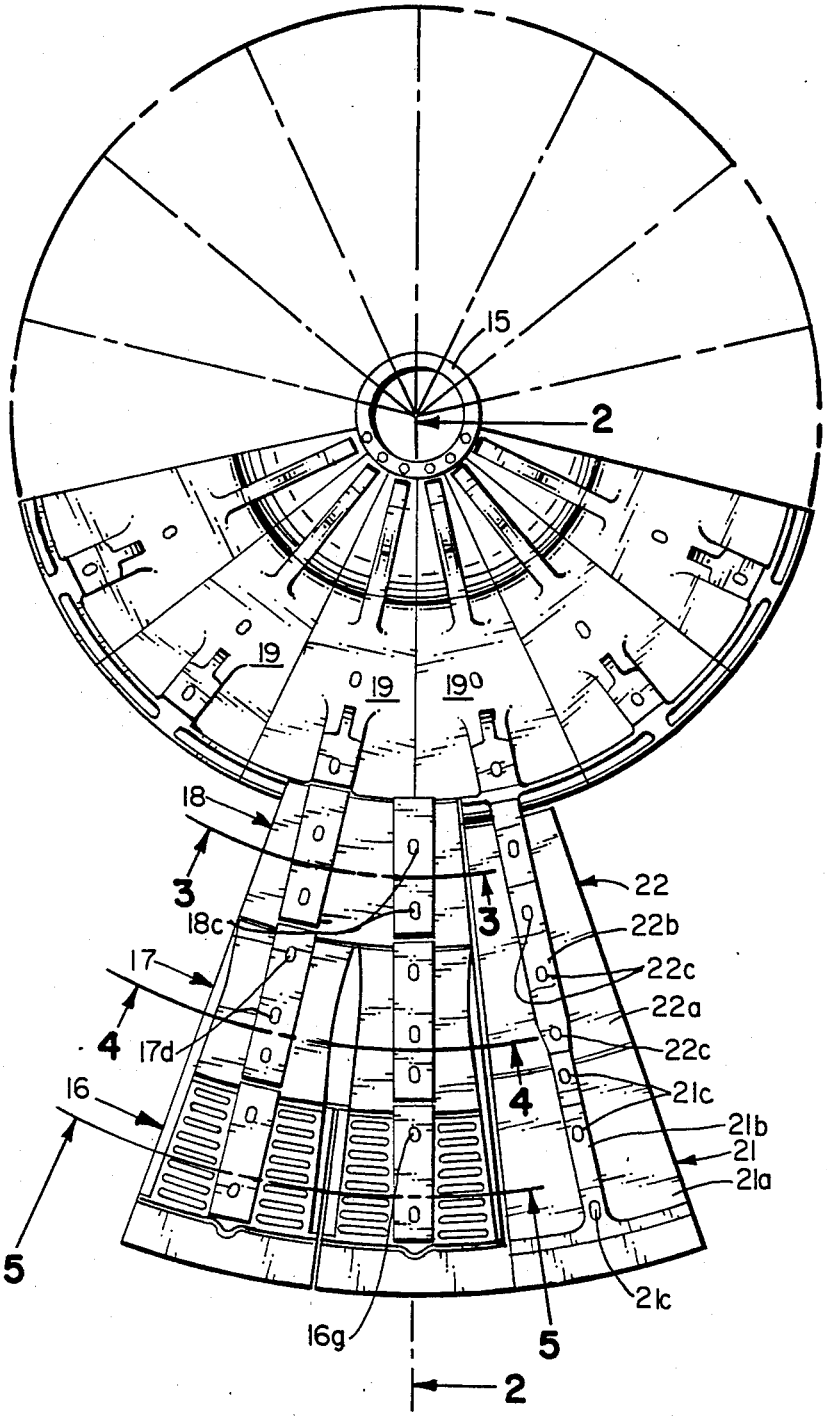
FIG. 1 is a fragmentary end view of the discharge end of a rotary grinding mill as viewed within the mill.
Figure 2:
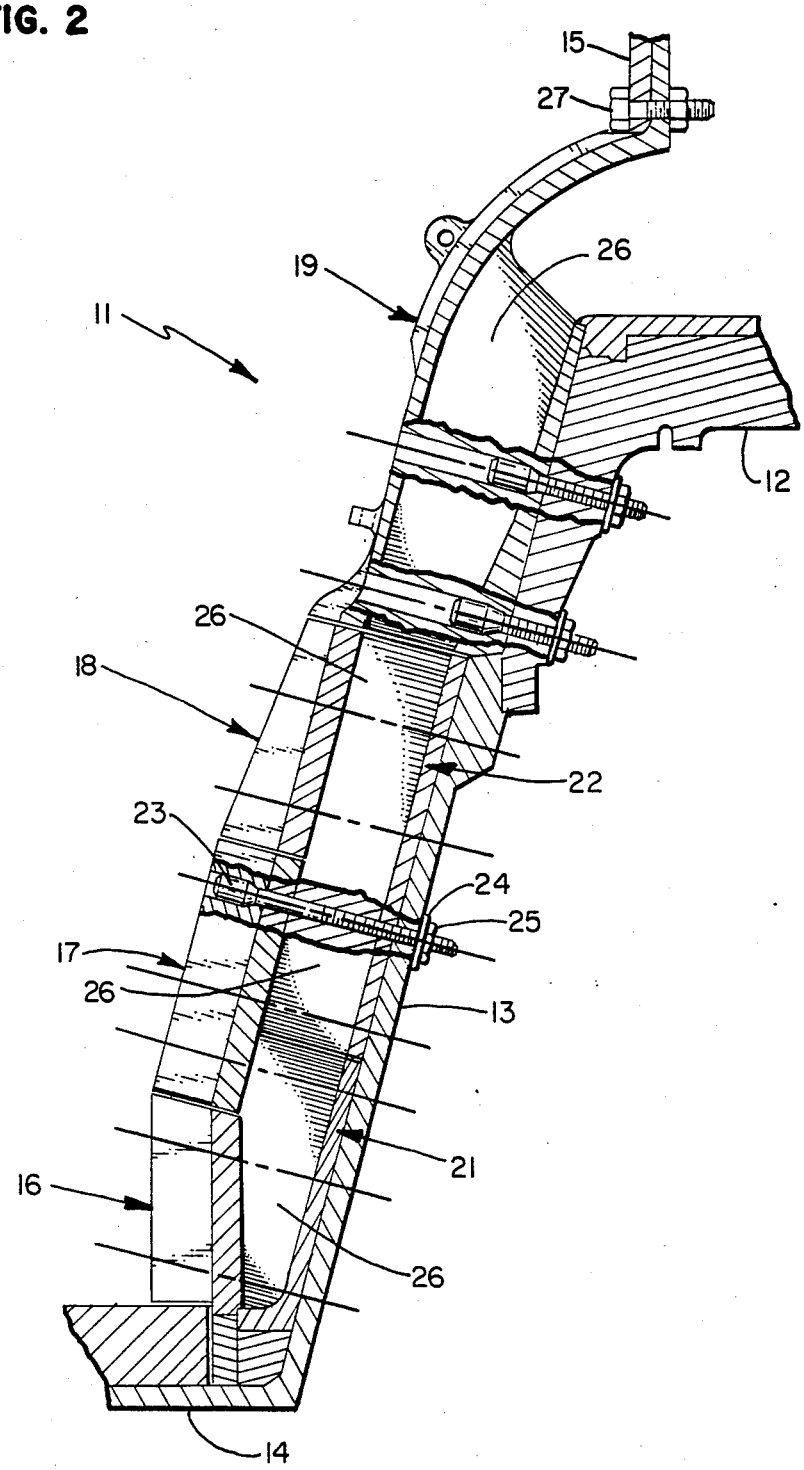
FIG. 2 is a fragmentary sectional view of the discharge end of the rotary mill as viewed along line 2—2 of FIG. 1.

With initial reference to FIGS. 1 and 2, a discharge end assembly for a rotary grinding mill is referred to generally by the numeral 11. The assembly 11 comprises a number of component castings discussed in further detail below, which are individually secured to the structure of the mill end. This structure includes a trunnion 12, an endplate 13, a cylindrical shell plate 14 and a retainer ring 15.

The mill end components 12–15 rotate about the rotational axis of a hollow trunnion 12 to comminute ore fragments introduced through an opposed inlet or charge end (not shown). The purpose of the discharge end assembly 11, which generally takes the form of a curved cone, is to receive and conduct the flow of slurry or dry comminuted material out of the mill. To accomplish this, the flow direction of the comminuted material must change from axial, along the internal cylindrical surface of the mill as it rotates, radially inward toward the center of the mill, and then axial at the mill discharge end within the trunnion, which defines the mill outlet.

The discharge end assembly consists of four separate sets of castings, which bear general reference numerals 16–19, respectively. The castings 16 are disposed the farthest radial distance from the mill axis, and together define an annular array or ring extending 360° around the discharge end. The castings 17 are disposed radially contiguous with the castings 16, and also define an annular ring or array extending 360° around the mill discharge end. Similarly, the castings 18 are radially contiguous with the castings 17 and define a smaller annular array radially within the other two.

The castings 19 are of considerably greater radial dimension than any of the castings 16–18, as shown in FIG. 1, and they occupy the radial distance between the innermost end of the castings 18 and the retaining ring 15.

Figure 3:
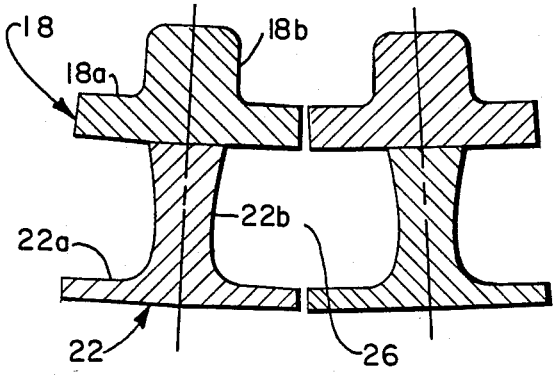
FIG. 3 is an enlarged sectional view taken along the line 3—3 of FIG. 1.
Figure 4:
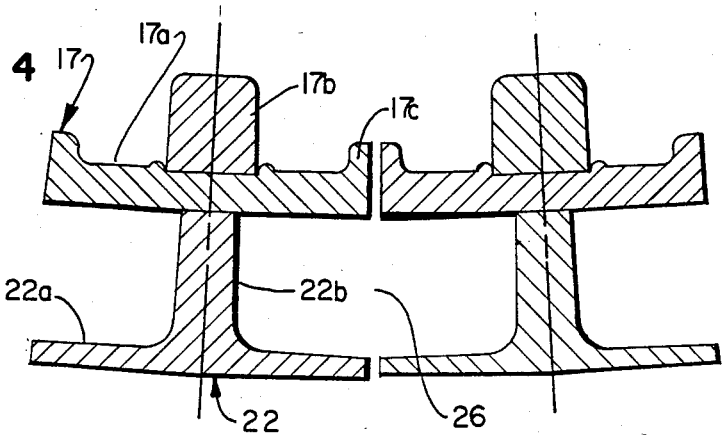
FIG. 4 is an enlarged sectional view taken along the line 4—4 of FIG. 1.
Figure 5:
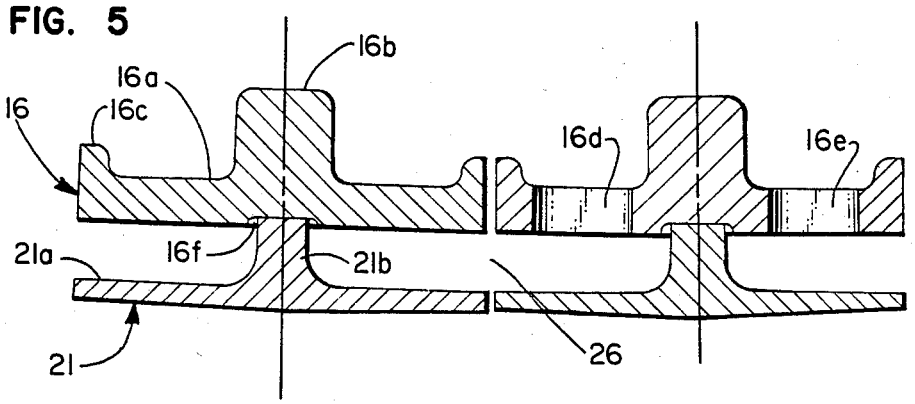
FIG. 5 is an enlarged sectional view taken along the line 5—5 of FIG. 1.
Figure 9:
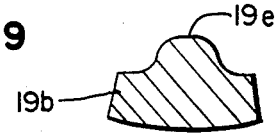
FIG. 9 is an enlarged sectional view taken along the line 9—9 of FIG. 7.

With continued reference to FIG. 1, and with additional reference to FIGS. 3–5, it will be seen that the castings 16–18 are in essence caps that overlie and are carried by wear castings 21, 22 that contact the mill end. These castings 21, 22 are also respectively arranged in annular arrays, and together occupy the same radial distance as the castings 16–18.

With reference to FIGS. 1, 2 and 5, each of the wear castings 21 has a cross section taking the form of an inverted T defined by a flat base 21*a* and an upstanding web 21*b*. Three bolt holes 21*c* are formed through the upstanding rib 21*b* in spaced apart relation.

The cap casting 16 that overlies a portion of wear casting 21 comprises a relatively flat but thicker base 16*a*, a large, centrally disposed rib 16*b* and smaller half ribs 16*c* that together form a full but smaller rib with the adjacent casting. A plurality of grates 16*d*, 16*e* are formed on opposite sides of the large rib 16*b*, and these grates accept the slurry or dry comminuted material from within the mill to initiate the flow of material toward the mill outlet.

With specific reference to FIG. 5, it will be seen that each of the cap castings 16 has a centrally disposed recess 16*f* below the rib 16*b* sized to receive the web 21*b* of the underlying wear casting 21. This interrelationship insures that the casting 16 is located properly.

Casting 16 further includes mounting bores 16*g* that are aligned with two of the mounting bores 21*c*, permitting a single bolt to pass through the aligned openings in the castings and an aligned opening in the endplate 13. A typical mounting bolt 23 with sealing washer 24 and nut 25 is shown in FIG. 2 in connection with the casting 17, and the same mechanical arrangement is used for all of castings 16–18 and 21–22.

As assembled, and with reference to FIG. 5, a channel 26 is defined between the castings 16 and 21 through which comminuted material begins its upward flow.

With reference to FIGS. 1, 2 and 4, casting 22 also comprises a flat base 22*a* and a taller upstanding web 22*b* having essentially straight sides. A plurality of bolt holes 22*c* are formed in the upstanding web 22*b* and extend entirely therethrough.

The overlying cap casting 17 also has a substantially flat base 17*a* and large upstanding rib 17*b* with half ribs 17*c* formed along each edge. Mounting bolt holes 17*d* are formed in alignment with two of the mounting openings 22*c* and the mounting opening 21*c* that is overlapped by the casting 17. These castings are also mounted by locking bolts 23, sealing washers 24 and nuts 25.

As assembled, and with reference to FIG. 4, the channel 26 continues radially inward between the castings 17, 22, although its width is diminished because it is closer to the center of the mill, and its depth is commensurately increased by the height of web 22*b* so that the volume flow of the slurry or comminuted ore is not reduced.

With reference to FIGS. 1–3, the upright web 22*b* of casting 22 has diverging sides where it underlies the cap casting 18. Cap casting 18 itself comprises a flat but relatively thick base 18*a* and an upright thick rib 18*b*. Mounting bolt openings 18*c* are formed in alignment with the remaining mounting openings 22*c*, and the assembly is bolted to the endplate 13 as described above.

The channel 26 at the point shown in FIG. 3 has a further reduced width and a slightly greater depth with slightly rounded sides.

Figure 6:
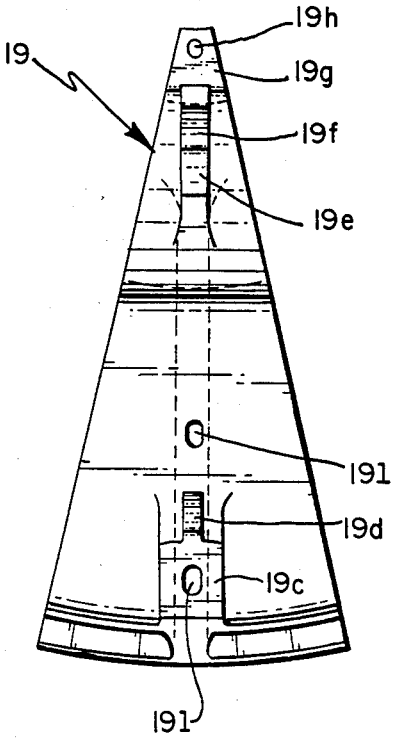
FIG. 6 is an enlarged end view of a cone discharge casting forming part of the mill discharge end assembly viewed from the same perspective as FIG. 1.

The discharge castings 19 are shown in FIGS. 1–2 and 6–11. With reference to FIG. 6, each of the discharge castings 19 generally takes the form of a truncated triangle, having straight converging sides and arcuate upper and lower edges. As pointed out above, the castings together define an annular array occupying the area between the retainer ring 15 and the upper edge of castings 18 and 22.

Figure 7:
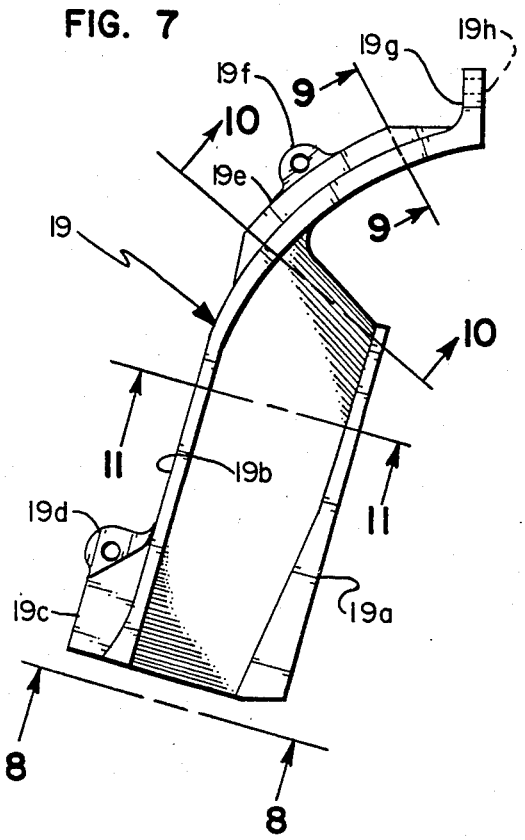
FIG. 7 is a view in side elevation of the cone discharge casting of FIG. 6.
Figure 10:
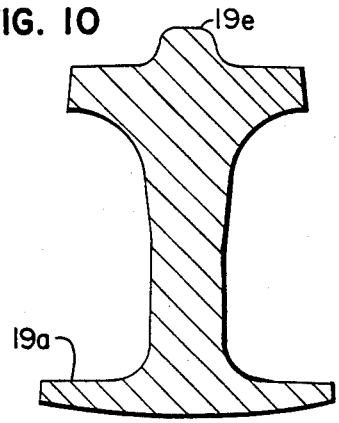
FIG. 10 is an enlarged sectional view taken along the line 10—10 of FIG. 7.
Figure 11:
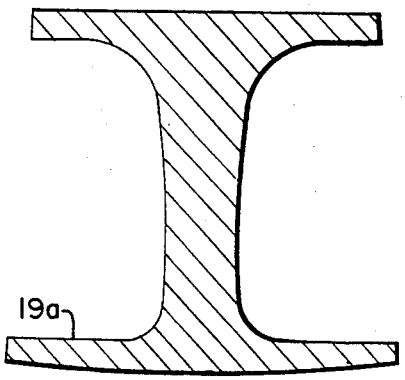
FIG. 11 is an enlarged sectional view taken along the line 11—11 of FIG. 7.
Figure 12:
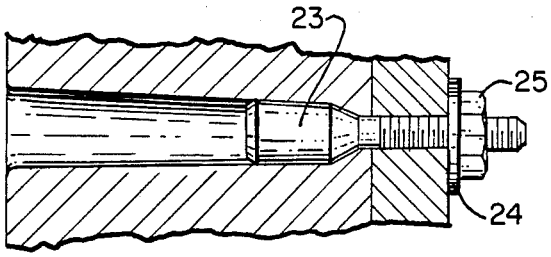
FIG. 12 is an enlarged fragmentary sectional view exemplifying connection of the cone discharge casting to the mill.

With reference to FIGS. 8–11, it will be seen that the discharge casting 19 comprises a base 19*a* that is generally flat and relatively thick at the lower end of the casting (the base of the truncated triangle), and which diminishes in width as it approaches the upper portions of the casting due to the converging sides of the triangular configuration, and which also diminishes in thickness toward the upper portions of the casting (see FIGS. 7, 10 and 11).

Casting 19 further comprises a top or outer plate 19*b* that also takes the form of a truncated triangle, although it is less truncated due to its greater length. The top plate has a first portion that is generally flat and disposed in substantially parallel overlying relation to the base plate 19*a*. A second portion of the top plate 19*b* extends longitudinally beyond the base 19*a* and curves arcuately inward toward the plane of the base plate 19*a* and toward the axial discharge within the hollow trunnion 12 (FIG. 2). FIGS. 2 and 7 also show that the top plate 19*b* is longer than the base plate 19*a* to establish the necessary curvature to channel the comminuted output from radially inward to axially outward flow.

Figure 8:
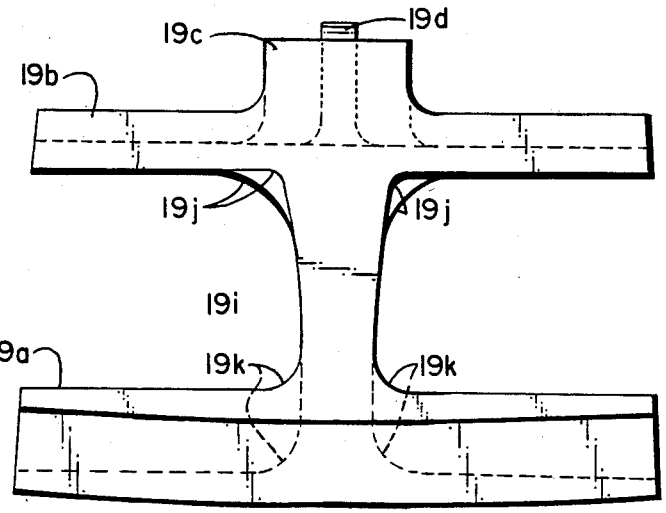
FIG. 8 is an enlarged bottom view of the cone discharge casting as viewed from the line 8—8 of FIG. 7.

The first portion of top plate 19*b* is substantially the same thickness over its length, although it is somewhat thicker at the inlet end. Also, as shown in FIGS. 7 and 8, it has a relatively thick rib 19*c* along its lower edge that supports and carries a lifting hook 19*d*. In the arcuate second portion of top plate 19*b*, another rib 19*e* of somewhat greater length but smaller in cross sectional size carries a lifting hook 19*f*. Further, the second portion gradually increases in thickness through its curvature, as the sides converge.

With reference to FIGS. 6 and 7, the top plate 19*b* terminates at its upper end in an upwardly projecting flange or mounting ear 19*g* that is configured to receive the retainer ring 15, and includes a bolt hole 19*h*. As shown in FIGS. 1 and 2, the retainer ring 15 fits over the ears 19*g*, and a plurality of nut and bolt assemblies 27 mechanically secure these components together.

With reference to FIGS. 6 and 8–11, the base plate 19*a* and top plate 19*b* are interconnected by a single centrally disposed upstanding web 19*i*, and the cross section of cone discharge casting 19 thus takes the form of an I-beam.

Adjacent discharge cone castings 19 define a continuation of the channel 25, and as best shown in FIG. 2, the channel 25 within casting 19 is initially directed radially inward of the rotary mill (generally upward as viewed in FIG. 2), then sweeping into an axial direction within the hollow trunnion 12 as a result of curvature of the top plate 19*b*. This curvature is arcuate and smooth to minimize the abrasive force of the discharged slurry or dry material. It will also be noticed in FIGS. 8–11 that the regions of connection of the base plate 19*a* and top plate 19*b* with the upstanding web 19*i* are in all cases smooth and contoured, as indicated by the filets 19*j*, 19*k*.

Two mounting holes 19*l* are formed directly through the web 19*i* in alignment with holes in the mill endplate 13 to receive mounting bolts. Directly bolting the castings 19 to the endplate 13 positively secures them during all phases of operation, avoiding problems of shifting encountered with prior art assemblies.

It is of essential importance that the discharge cone casting 19 is integrally formed as a one-piece casting, obviating the existence of seams or joints at critical points which, in prior art structures, abrade easily and wear much more quickly. The filets 19*j*, 19*k* assist in this regard, exposing only rounded corner surfaces to the slurry, and avoiding the high abrasion and wear encountered with prior art castings.

Also important is the recognition of potential wear areas within the casting 19, and providing thicker walls for more material in such areas so that wear of the casting is balanced and uniform throughout. Such areas include the filets 19*j*, 19*k*, and the thicker portions of the base plate 19*a* and top plate 19*b* as described above.

The lifting hooks 19*d*, 19*f* may be used singly or together in removing or installing the castings 19.

Figure 13:
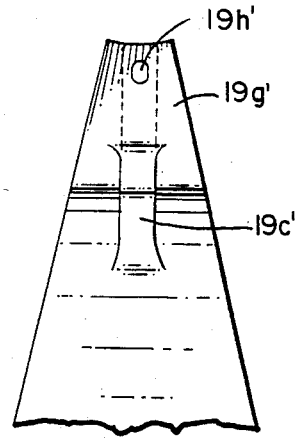
FIG. 13 is an enlarged fragmentary end view of an alternate form of the cone discharge casting.
Figure 14:
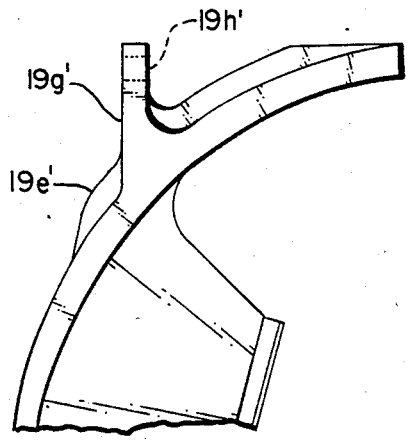
FIG. 14 is an enlarged fragmentary side view of the cone discharge casting of FIG. 13.

FIGS. 13 and 14 disclose an alternate form of the casting 19, in which the curved portion of the top plate 19*b* has an arcuate rib 19*e'* from which an ear 19*g'* projects upwardly with a mounting bolt opening 19*h'* formed therein. The location of the ear 19*g'* requires a retainer ring 15 of greater diameter, but the ear 19*g'* and bolt opening 19*h'* also serve as a lifting hook, thus obviating the need for two lifting hooks as shown in the primary embodiment.

Because the casting 19 has no joints, it inherently resists abrasive wear by the comminuted material and lasts longer. The use of filets where joints exist in prior art castings further reduce wear, and the thickened portions in high wear areas result in balanced and uniform overall wear of the casting. The single, centrally located upstanding web receives mounting bolt holes for mounting the casting directly to the mill end firmly and securely, obviating the problems of shifting with prior art structures.

The integral cone discharge casting is easier to remove and install than the prior art structures because it is more easily handled and does not require assembly of multiple components and alignment. It lasts longer, requires less maintenance, decreases replacement time and leads to less mill downtime and reduced mill maintenance costs.

We claim:

1. A discharge cone casting for the discharge end of a rotary mill, comprising:

a generally flat base member having a bottom surface adapted to conform to the mill discharge end and a top surface, the base member generally taking the form of a truncated triangle and having a predetermined longitudinal dimension with converging sides;

a top member having converging sides similar to those of the base member and a greater longitudinal dimension, one portion of the top member being generally flat and disposed in substantially parallel, overlying relation to the base member, and a second portion of the top member extending beyond the base member and curving toward the plane thereof;

and an interconnecting web member extending transversely between the base and top members and disposed centrally thereof to define a generally I-shaped cross section therewith, the web member being integrally formed with said base and top members to create a jointless single casting.

2. The discharge cone casting defined by claim 1, wherein the regions of integral connection of the top and bottom base members with said web member are formed as filets.

3. The discharge cone casting defined by claim 1, which further comprises at least one lifting hook for the casting integrally formed on the outer surface of the top member.

4. The discharge cone casting defined by claim 3, which further comprises a rib integrally formed on the outer surface of the top member and disposed along the center line thereof, said lifting hook being integrally formed with and projecting from said rib.

5. The discharge cone casting defined by claim 3, which comprises two of said lifting hooks, one being integrally formed on said one portion of the top member, and the other being integrally formed on said second portion of the top member.

6. The discharge cone casting defined by claim 1, wherein each of said lifting hooks projects from a rib integrally formed on the outer surface of the top member.

7. The discharge cone casting defined by claim 1, which further comprises a mounting ear integrally formed on the outer surface of the second portion of said top member, the mounting ear being constructed and disposed to be connected to a retainer ring that commonly interconnects a plurality of said discharge cone castings.

8. The discharge cone casting defined by claim 7, wherein said mounting ear is disposed at the extreme end of the second portion of said top member.

9. The discharge cone casting defined by claim 7, wherein said mounting ear is disposed at an intermediate point of the length of the second portion of said top member.

10. The discharge cone casting defined by claim 1, wherein the base plate is of predetermined thickness at the base of said truncated triangle, and becoming progressively thinner over at least a portion of the base plate as the sides converge.

11. The discharge cone casting defined by claim 1, wherein the first portion of the top member has its greatest thickness at the base of said truncated triangle.

12. The discharge cone casting defined by claim 1, wherein the thickness of the second portion of said top plate increases as said sides converge.

13. The cone discharge assembly defined by claim 1, wherein a plurality of mounting openings are formed through the interconnecting web member to receive mounting nut and bolt assemblies.

* * * * *